US005471116A

United States Patent [19]

Schiller

[11] Patent Number: 5,471,116

[45] Date of Patent: Nov. 28, 1995

[54] GENERAL ASSEMBLY FOR CONTROLLING LIGHT INTENSITY OF A GAS DISCHARGE LAMP

[75] Inventor: Uri Schiller, Tel-Aviv, Israel

[73] Assignee: Ready Light Energy Ltd. Israeli Company, Rishon le Zion, Israel

[21] Appl. No.: 166,501

[22] Filed: Dec. 13, 1993

[30] Foreign Application Priority Data

Apr. 30, 1993 [IL] Israel ..... 105564

[51] Int. Cl.[6] ..... H05B 37/02

[52] U.S. Cl. ..... 315/209 R; 315/360; 315/DIG. 4

[58] Field of Search ..... 315/209 R, DIG. 4, 315/279, 224, 307, 360, 158, 225, 208, 297, DIG. 7, 291

[56] References Cited

U.S. PATENT DOCUMENTS 4,876,498 10/1989 Luchaco et al. ..... 315/DIG. 4 X
4,950,963 8/1990 Sievers ..... 315/360

FOREIGN PATENT DOCUMENTS 0417315 3/1991 European Pat. Off. .
2136226 9/1984 United Kingdom .
9002475 3/1990 WIPO .

*Primary Examiner*—Ali Neyzari
*Attorney, Agent, or Firm*—Helfgott and Karas

[57] ABSTRACT

A novel dimming assembly for controlling light intensity of a gas discharge lamp, including:

dimming controller having an input terminal connectable to one pole of an alternating current source and having an output terminal connectable to the line leading to one of the two filament electrodes of the lamp, the dimming controller being adapted to provide an attenuated and conditioned power at its output terminal;

the dimming controller being adapted upon feeding the input terminal with the current, to operate in full power mode for a time period $t_1$, during which the link between the two terminals is in full conductance bringing about full light intensity of the discharge lamp, and being further adapted after $t_1$ to enter into a dimming mode, during which the link between the two terminals is in partial conductance bringing about attenuated intensity of the discharge lamp; the said time $t_1$ is sufficient to facilitate effective dimming in the dimming mode. By another embodiment the dimming controller is adapted upon feeding the input terminal with the current, to gradually switching, for a period $t_2$, into dimming mode in which the link between the two terminals is in partial conductance bringing about attenuated intensity of the discharge lamp, the time delay $t_2$ is sufficient for facilitating effective dimming.

17 Claims, 4 Drawing Sheets

GENERAL ASSEMBLY FOR CONTROLLING LIGHT INTENSITY OF A GAS DISCHARGE LAMP

FIELD OF THE INVENTION

The present invention concerns an apparatus for dimming light of gas discharge lamps such as fluorescent lamps.

BACKGROUND OF THE INVENTION

It is very often desired to utilize a lamp at a less than maximum intensity. For this purpose, typically dimmers are installed in the circuit supplying the electric power to such lamps.

Most dimmers operate on a basis of chopping the power, meaning, transmitting only through part of the time of the alternating current cycle, shutting it off during the rest. The extent of the transmission time in each cycle determines the amount of dimming.

Dimmers typically consist of a user-controlled potentiometer operating in conjunction with a triac or an SCR.

Most available dimmers, particularly such as available in domestic use, are capable of dimming a light of lamps such as incandescent type lamps or halogen lamps. However, standard dimmers are unsuitable for dimming light of gas discharge lamps such as fluorescent lamps, high or low pressure mercury or sodium lamps, etc. When attempting to dim such lamps by conventional dimmers that are used for example, for incandescent or halogen lamps, the light of a gas discharge lamp either flickers or extinguishes altogether.

There is a long felt need for dimmers suitable for use with gas discharge lamps particularly in view of the popularity of such types of lamps. As is no doubt is known to the artisan, the popularity of such lamps stems to a large extent from their very high efficiency, meaning the very high ratio of illumination intensity to power consumption.

Gas discharge lamps have a gas filled space or tube with two spaced electrodes (heated or not). When heated, an electrode is a two terminal filament. One terminal of each of the two electrodes is connected to a pole of the AC power source and the other terminals of the two electrodes are typically linked together by the intermediary of a so-called "starter".

A choke/ballast is installed between one of the electrodes and the respective pole of the power source and sometimes a capacitor is installed in series or parallel to the lamp to correct the power factor (cos-fi) and/or limit the current.

In order to initiate an electric discharge through the gas, an initial high voltage, that can supply enough electric charge is required. When the power is turned on, an appropriate voltage is to be generated to cause such a discharge.

For a fluorescent lamp, that has heated electrodes, the electric current flows at first, through the choke, one filament electrode of the starter and the second filament electrode of the lamp. After an initial short period of time, the filaments are hot and the starter disconnects, with the result of abrupt current change through the choke which, in turn, causes a very high voltage across the fluorescent lamp, above the threshold required for ignition of the discharge. Following initial ignition, the gas discharge lamp continues to emit light while the choke limits the current, as long as it is supplied with electric power above a minimal value.

There are available dimmers for gas discharge lamps such as fluorescent lamps. For example, in Hi-Fi dimmers, the standard choke is replaced by an electronic choke which is an oscillator that generates an alternating electric power at high frequency, of the order of 25–100 KHz. In such dimmers, dimming is achieved by modulating the oscillator and whilst effective dimming is achieved, such dimmers entail significant drawbacks in that they are somewhat inefficient and expensive and that retrofitting a light circuit to operate them requires relatively expensive hardware.

Other types of dimmers involve the use of a heating transformer intended to preheat the filaments in order to reduce the threshold voltage required to initiate the gas discharge.

The drawback here is similar to that of the Hi-Fi dimmers in that it requires a very expensive hardware. Furthermore, such dimmers are inappropriate for various kinds of gas discharge lamps that do not depend on preheating of their electrodes such as various types of high pressure gas discharge lamps and high or low pressure mercury or sodium lamps and others.

It is the object of the present invention to provide a novel dimmer for gas discharge lamps.

It is furthermore the object of the invention to provide a dimmer which can easily be installed in already existing installation of gas discharge lamps.

It is furthermore the object of the present invention to provide such dimmers involving the use of inexpensive hardware.

GENERAL DESCRIPTION OF THE INVENTION

The present invention is based on the surprising finding that unlike prior belief in this field, effective dimming of a gas discharge lamp may be achieved by the use of circuitry, which can be installed into a standard circuitry without a need for cumbersome and expensive retrofitting of the circuitry.

The term "effective dimming" used above and below, denotes the dimming of light for prolonged time periods without light flicker or occasional lamp extinguishing.

It has been found in accordance with one embodiment of the invention, that where a relatively high degree of dimming is desired, to achieve light output less than 50% of maximal output, the lamp has to operate at essentially maximum power for a certain period of time before effective dimming can be achieved. The extent of time in which the lamp has to operate in full power depends on the extent of dimming desired. It should nevertheless be appreciated that the term "full power mode" is to be interpreted in the context of the description and the appended claims as essentially "full power mode". Thus, for example, 90% of the maximal power is considered in some cases as full power mode.

Thus, in accordance with the present invention there is provided a dimmer assembly for controlling light intensity of a gas discharge lamps, comprising:

dimming controller having an input terminal connectable to one pole of an alternating current source and having an output terminal connectable to the line leading to one of the two filament electrodes of the lamp, the dimming controller being adapted to provide an attenuated and conditioned power at its output terminal;

the improvement being in that:

the dimming controller being adapted upon feeding the input terminal with the current, to operate in a first mode constituting a full power mode for a time period $t_1$, during which the link between the two terminals is in full conductance bringing about full light intensity of the discharge lamp, and being further adapted after $t_1$ to enter into a second mode constituting a dimming mode, during which the link between the two terminals is in partial conductance bringing about attenuated intensity of the discharge lamp; the said time period $t_1$ is sufficient to facilitate effective dimming in the dimming mode.

In accordance with a second embodiment of the invention it has been found that particularly where the dimming means controls light in a plurality of lamps, in order to achieve effective dimming, the transition from a non-dimmed, i.e. maximal power state, into a state in which the light has been dimmed should be gradual. The duration of the transition period between maximal power state and a dimmed state depends on various factors including the number of lamps, the type of lamps used and other factors. The correlation between these factors and the aforesaid time duration has to be determined in each particular case.

Accordingly, by a second aspect of the invention there is provided a dimmer assembly for controlling light intensity of a gas discharge lamp, comprising:

dimming controller having an input terminal connectable to one pole of an alternating current source and having an output terminal connectable to the line leading to one of the two filament electrodes of the lamp, the dimming controller being adapted to provide an attenuated power at its output terminal;

the improvement being in that: the dimming controller is adapted upon feeding the input terminal with alternating electricity, to gradually switch, for a transition time period $t_2$, into dimming mode in which the link between the two terminals is in partial conductance bringing about attenuated intensity of the discharge lamp. The said transition time period $t_2$ is sufficient for facilitation of an effecting dimming in the dimming mode. It may be appreciated by the artisan that in various applications a dimming assembly may incorporate characterizing features of both of the above embodiments. Thus, by way of example, in case of a large number of lamps and a high degree of desired dimming, both a full power and a gradual transition to dimming mode may be implemented.

It should be noted that the time periods $t_1$ and $t_2$ should be adjusted in accordance with the particular application. Typically, the extent of the desired dimming, the number and type of lamps used and various other factors affect the values of $t_1$ and $t_2$. By way of example, in case of a single lamp and a desired dimming extent of 50%, $t_1$ may be selected to be 50 secs. and $t_2$ to be 200 secs. It should be noted that for a given lighting system $t_1$ and $t_2$ may be automatically adjusted for a given desired dimming extent.

The dimming controller in the dimmer assembly of the invention may be any suitable means such as those operated on the basis of signal chopping, e.g., using triacs or SCRs, using an impedance control system, etc.

In case of signal chopping, the dimming is achieved by blocking the electric current from going through the lamps during part of each half of the AC cycle, following the "zero crossing", and letting it flow during the rest of the half cycle. This chopping repeats itself each half cycle.

Typically, a triac or twin SCR's together with a programmable controller and timer, form collectively the dimming controller of the invention. In case of high dimming extent, and the consequent risk of damage by virtue of power spikes, the triac, if needed, is protected by a passive "body guard".

The Triac body guard is typically a saturable inductor or a collapsible resistor that restricts the current during switching of the signal chopping means but has essentially no impedance once the current exceeds some critical value. By so doing, the body guard greatly diminishes the energy deposition in the signal chopping means during the switching time, thereby protecting it from being damaged.

In case of a power failure, when the power is resumed, the controller repeats the foregoing sequence of operations whereby the lamps are automatically restarted and brought into the desired dimmed condition.

It has been found that effective dimming of fluorescent lamp or lamps assembly, to an extent in which the lamp's illumination intensity drops below about 80% of its maximum, can be achieved by replacing the standard starter coupling between the filaments, which is typically a bimetal based device, with a staffer which during the ignition process and after an initial time delay in which current passes there-through, essentially disconnects the electric contact between the two filament electrodes of the lamp, whereby the only electric path between the two electrodes being then through the discharge gas inside the lamp. An example of such a starter is an electronic starter, many of which are available.

Thus, in accordance with another embodiment of the present invention, there is provided a dimmer assembly of the kind specified further comprising a starter unit having two terminals one connectable to each of the filament electrodes of the lamp, which, when initially energized enables electrical connectivity between the electrodes, and after a predetermined time delay disconnects the said electrical connectivity, whereby the only connection between the two electrodes being then through the discharged gas inside the lamp. By disconnecting, it is meant that the current flow through the starter drops to essentially zero.

The starter in accordance with this embodiment, may be, by way of example, an electronic starter. It should be noted that contrary to such an electronic starter, the standard bimetal starters can resume contact if the voltage decreases beyond a certain value and thus by the use of such starters, in a dimming mode of operation, there is risk of light flickering or a total distinguishing thereof.

The present invention further provides a lighting system comprising:

one or more gas discharge lamps each having two spaced electrodes, each electrode connected to one pole of an electric power source;

choke means and a starter unit associated with each lamp, and a dimmer controller on the electric line connecting one of the electrodes of each lamp to the one terminal of the power source, the dimmer controller being one of those specified above.

Retrofitting existing lighting systems to a system in accordance with the invention is a very simple and rapid procedure and involves only changing of the standard light switch to a dimmer assembly of the invention and setting the potentiometers and possibly, for fluorescent lamps that have filament-electrodes and use a bimetallic starter, also replacing the starter of each lamp with an electronic starter. There is no need for any additional change in the circuitry, unlike most other dimming systems available to date.

The operation in the dimming mode is characterized by an increase in the efficiency, that is the "light to power" ratio. It has been found that dimming in accordance with the invention is efficient in terms of consumption of energy.

The invention will be illustrated in the following by a description of some specific, currently preferred non-limiting embodiments.

BRIEF DESCRIPTION OF THE DRAWINGS

The non-limiting embodiments of the present invention are shown in the drawings in which.

DETAILED DESCRIPTION OF THE INVENTION

The controller of the present invention can be realized by utilizing digital components, analog components or a combination thereof.

By one embodiment the controller consists exclusively of hardware components. The time period $t_1$ of the full power is determined by an RC circuit and its setting is made with a potentiometer. The transition time period $t_2$ is controlled by another RC circuit and is set by a second potentiometer. The level of dimming is set by a third potentiometer. Alternatively, the operation of the dimming controller may be realized by a suitably programmed controller.

Figure 1:
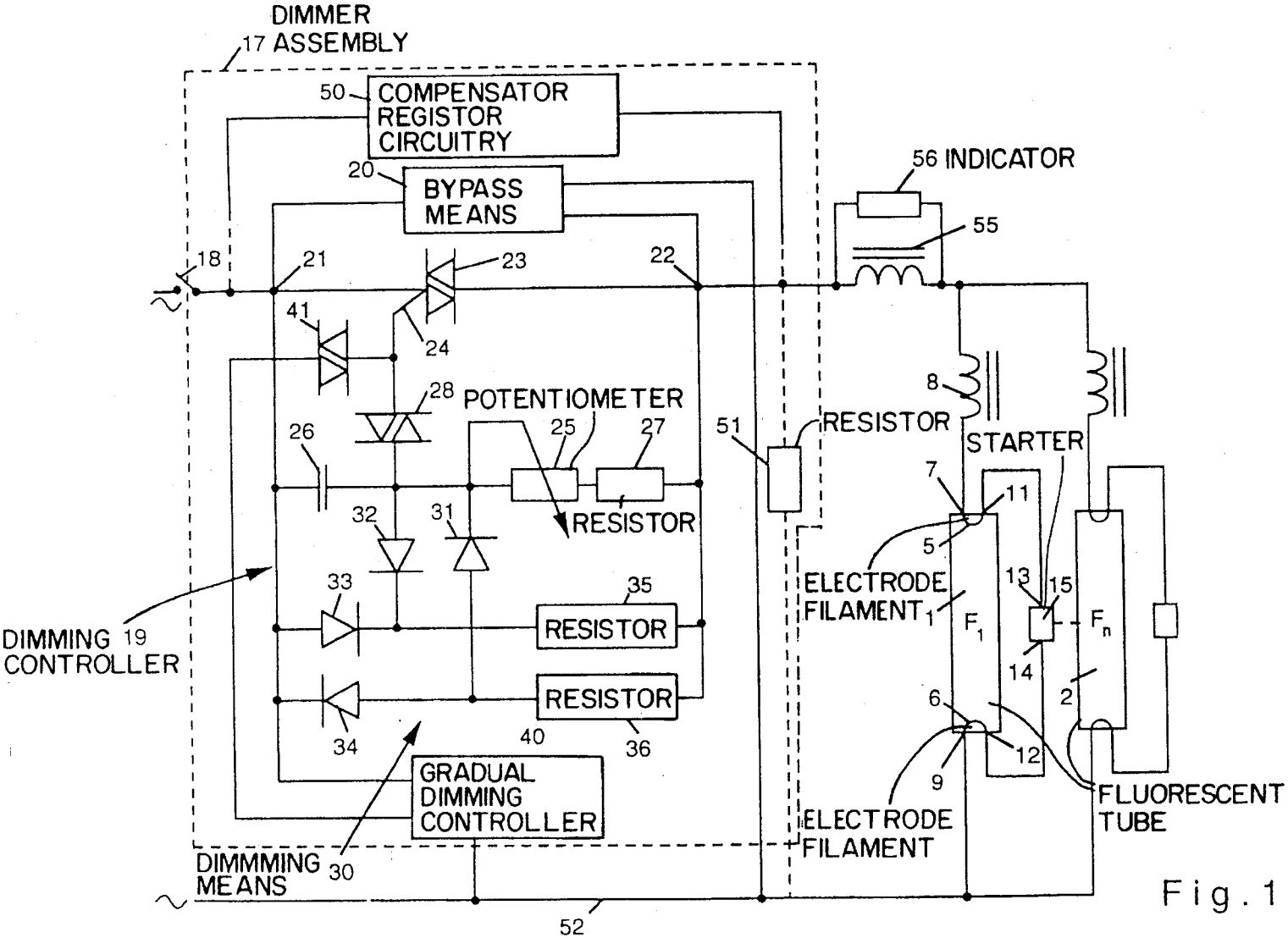
FIG. 1 shows the circuit of a light system in accordance with one embodiment of the invention.

For the explanation of a second far more detailed embodiment, attention is first directed to FIG. 1 showing a light system of the invention. The system of this embodiment includes a plurality (n) identical fluorescent tubes of which only two are shown, those designated F1 and Fn. These fluorescent tubes may for example be standard, 40 W "day light" type of the kind manufactured by OSRAM™. Each of the tubes includes two spaced electrode filaments 5 and 6. One terminal 7 of filament 5 is electrically coupled to a proximal terminal of choke ballast 8, being for example of the kind manufactured by SHWABBE. Terminal 9 of electrode filament 6 is connected to one terminal of an AC (alternating current) power source, e.g. 220 volts, 50 Hz. The other terminals 11 and 12 of electrode filaments 5 and 6, respectively, are electrically coupled to respective terminals 13 and 14 of starter 15.

Dimmer assembly 17 comprises an on/off switch 18 (which may be coupled to a potentiometer 25 but which is shown herein for the sake of clarity as a separate component), dimming controller 19 and a bypass means 20.

Dimming controller 19 has an input terminal 21 and an output terminal 22. Linking the two terminals 21 and 22 is a triac component 23 which should be selected so that its maximal power output is compatible with the power requirements of the plurality of fluorescent tubes F1 to Fn. The power transmission through triac 23 is controlled by gate 24. Potentiometer 25 (which as pointed out above is coupled to switch 18) is linked to a user controlled dial whereby the user selects the required dimming degree. Potentiometer 25 operates in a combination with capacitor 26, resistor 27 and diac 28, in a manner which is no doubt clear to the artisan to modulate the voltage at gate 24 whereby the electric power through triac 23 is chopped depending on the selected position of potentiometer 25. (It should be noted that bypass means 20 may be implemented by triac 23 which when set to full conductance, by suitable modulation of gate 24, facilitates the bypass mode and alternatively when set to partial conductance facilitates the dimmed mode.

The dimming means also comprises an optional histeresis compensating circuitry generally indicated 30 which comprises four diodes 31–34 and resistors 35 and 36. The function of the histeresis compensation unit is to render the dimmer operation symmetrical in the sense that the current attenuation upon increase in the degree of attenuation will be the same at each point as where the dimming degree is decreased. The histeresis compensating means essentially confers increased users' convenience in that it neutralizes the known histeresis effect which is a common drawback shared by many dimming units.

As shown in FIG. 1, the dimmer assembly 17 comprises also a gradual dimming controller 40, adapted to provide for a gradual entry into a dimmed mode, and compensator resistor circuitry 50 the function of which will be elaborated further below.

In operation, when switch 18 is closed, bypass means 20 short circuits terminals 21 and 22 and consequently the entire electric power flows directly at full intensity to the plurality of fluorescent light bulbs F1 to Fn through their associated chokes 8. After a certain time delay, its minimum depending on the selected dimming extent determined by the position of potentiometer 25, the bypass means switches from the full power mode, to the dimming mode in which the direct connection between terminals 21 and 22 is disconnected and consequently the power between these two terminals is now routed entirely through dimming controller 19. The extent of power output at terminal 22 is determined by means of potentiometer 25 as explained above.

As can also be seen in FIG. 1, the system can operate with a plurality of fluorescent lamps, unlike many dimmers that are available today. However, when plurality of fluorescent lamps are utilized the gradual dimming controller 40 should be activated.

Saturable indicator 55 and its associated control circuitry shown schematically as component 56 being the "body guard" which, as recalled, serves for protecting the triac 23 from being damaged.

Figure 2:
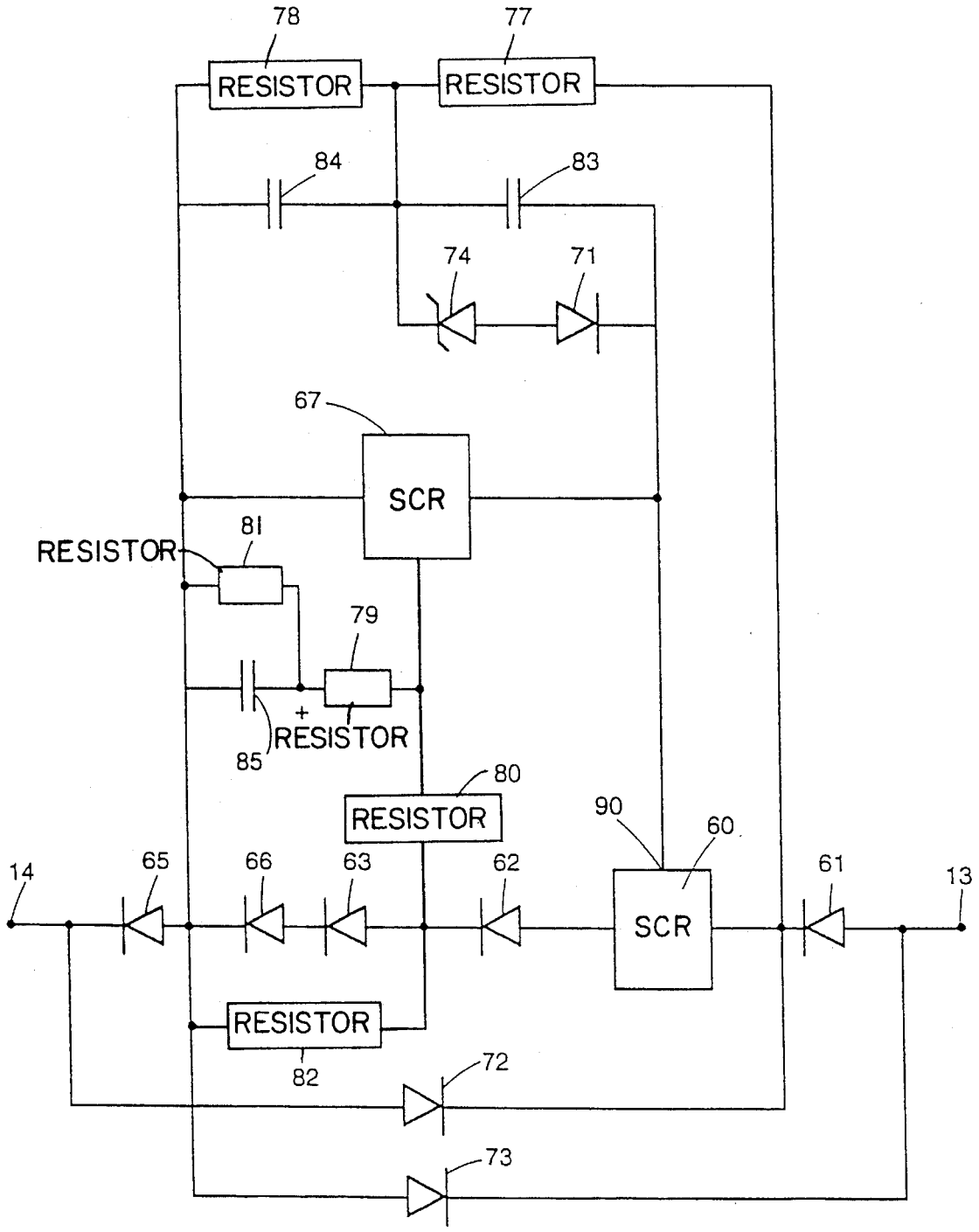
FIG. 2 shows the circuitry of a starter associated with a lamp in the embodiment of FIG. 1.

Reference is now being made to FIG. 2, showing a circuitry of the electronic starter unit 15 in FIG. 1. Starter 15 consists of an SCR 60 linked to terminal 11 through the intermediary of diode 61 and to terminal 12 through the intermediary of diodes 62–65. The circuitry further comprises an SCR 67, additional diodes 71–73, zener diode 74, a plurality of resistors 77–82 and three capacitors 83, 84 and 85. In operation, the sub-circuit consisting of resistors 77, 78, capacitors 83 and 84, diode 71, and zener diode 74 which is linked to gate 90 SCR 60, brings SCR 60 into a conduction mode in which current flows between terminals 11 and 12. After a certain time delay depending on the time constant of the sub-circuit consisting of resistors 79, 80, 81 and capacitor 85, SCR 67 enters into conduction mode whereby SCR 60 is disconnected and consequently the electrical contact between terminals 11 and 12 is disconnected. This disconnection then facilitates the ignition of the gas discharge effect as already discussed above.

As long as potential is applied to terminal 11, conductive conditions are maintained in SCR 67 and consequently SCR 60 is constantly disconnected essentially independent of the voltage at terminal 11.

Figure 3:
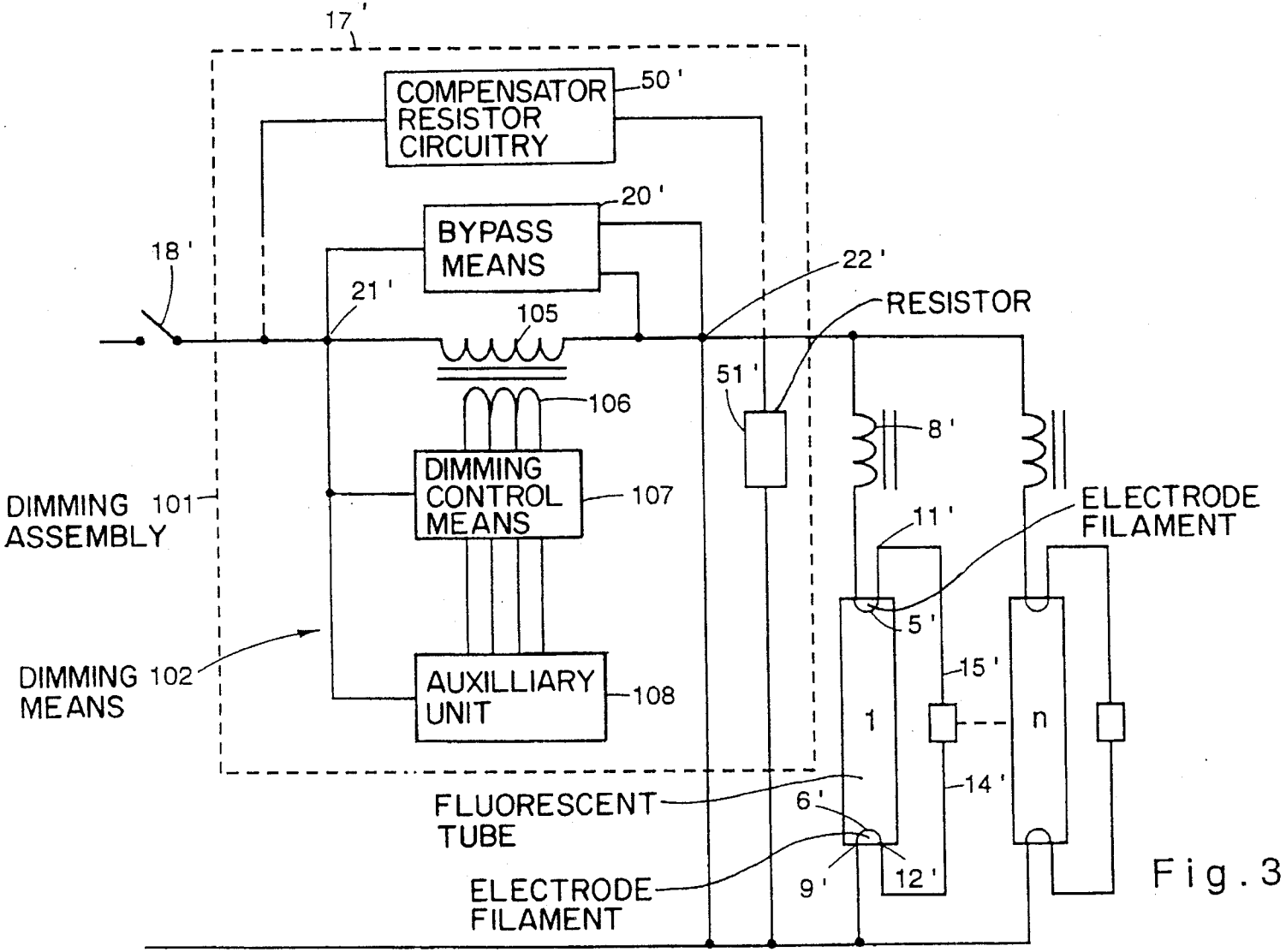
FIG. 3 is a diagram of the circuitry of a light system in accordance with another embodiment of the invention.

Attention is now being made to FIG. 3 showing a system in accordance with another embodiment of the invention. The operation of dimming assembly 101 in accordance with this embodiment is essentially similar to that in the embodiment of FIG. 1, the two differing from one another by the dimmer controller, generally designated 102, which in the embodiment of FIG. 4 operates on the basis of impedance control. All other features of the system are essentially identical to those of FIG. 1 and were given the same reference numerals with prime indications.

Dimmer means 102 comprise a primary coil 105 and a secondary coil 106. The dimming effect is achieved by changing the induction ratio between the primary and secondary coils 105, 106, respectively, which, in practice is obtained by selecting the active taps of coil 106. The taps are associated to user controllable dimming control means 107, whereby the user is capable of selecting the desired dimming extent. The number of taps determines the number of dimming levels. In FIG. 3, three taps are shown although it will be appreciated by the artisan that this is only an example and the secondary coil may have any other number of taps. Auxiliary unit 108 has the same function as auxiliary unit 40 in FIG. 1.

Figure 4:
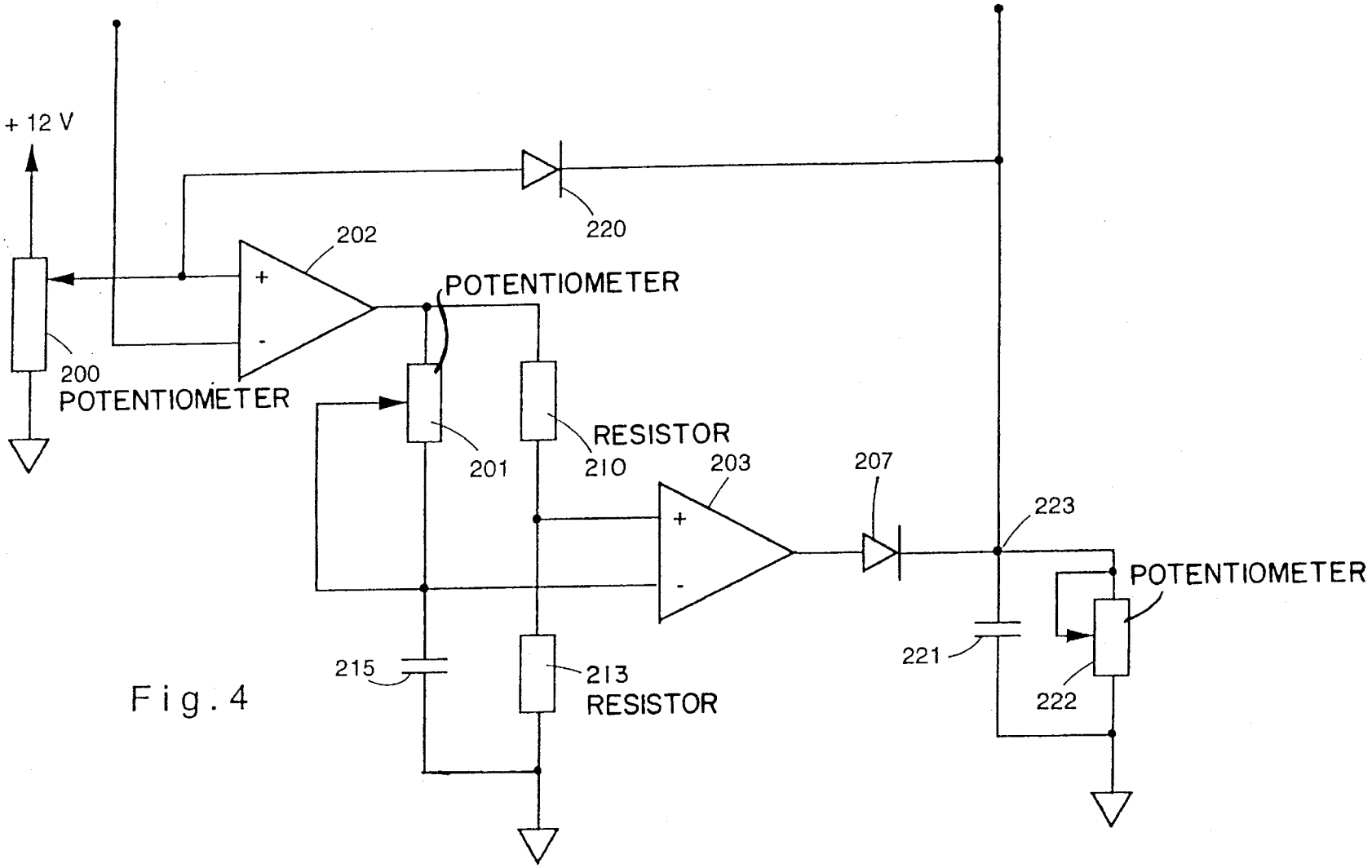
FIG. 4 shows the circuitry of the bypass and gradual dimming means in accordance with one embodiment of the invention.

Attention is now directed to FIG. 4 showing the circuitry of the bypass and the gradual dimming means (components 20 and 40). It should be noted, however, that in FIG. 4 both bypass means 20 and gradual dimming means 40 are incorporated together into one circuitry.

Potentiometer 200, 201, amplifiers 202, 203, diodes 207, 220, resistors 210, 213 and capacitor 215 constitute collectively the bypass means. The incorporation of the circuitry shown in FIG. 4 within the dimmer controller, such as that shown in FIG. 1, is not shown in the drawings as being straightforward to those versed in the art.

In operation, potentiometer 200 (which is similar in its function to potentiometer 25 of FIG. 1) is set to the desired dimming extent which should exceed a minimal threshold defined by reference voltage fed to the negative input of amplifier 202. The setting of potentiometer 200 results in generation of saturation voltage at the output of amplifier 202. The latter imposes a reference voltage, e.g. about 7.5 V, at the positive input of amplifier 203 which in turn forces positive saturation at the output of amplifier 203 thereby facilitating the so-called full power mode. The negative input of amplifier 203 will exceed the 7.5 V reference voltage after the capacitor 215 is charged to the suitable threshold so as to force an equivalent voltage (e.g. about 7.5 V) at the negative input of amplifier 203.

The charging rate of the capacitor 215 is contingent on the time delay defined by the potentiometer 201 and capacitor 215, and may, for example, be about 3 minutes. Once the negative input voltage of amplifter 203 exceeds the reference voltage, the output of latter drops to 0 due to diode 207.

As the power at the output of amplifier 203 drops to 0, the input power is routed via triac 23 (refer to FIG. 1) thus facilitating the so-called dimmed mode. The control signal to the gate of the triac 23 is fed via the potentiometer 200 and diode 220. It should be noted that the circuit may be easily modified, as is well known to the artisan, so that the position selected by the user in potentiometer 200 controls the time delay which in FIG. 4 is determined merely by the combination of potentiometer 201 and capacitor 215.

The gradual dimming is achieved by potentiometers 200, 222, diodes 207, 220, amplifier 203 and capacitor 221. As the power of the output of the diode 207 drops to zero (which is due to the negative saturation at the output amplifier 203), the voltage potential of junction 223 remains in positive saturation due to capacitor 221 which was changed during the full power mode period thus maintaining initial full power in spite of the power drop at the output of amplifier 203. The gradual attenuation terminates as the voltage potential at junction 223 drops to the level determined by the potentiometer 200 (via diode 220) entering full dimmed mode.

It should be noted that by this embodiment there is no discrete path which bypasses triac 23. Accordingly, the current flows through the triac both in full power mode and in dimmed mode. However, in the latter mode the gate controls the operation of the triac whereas in the prior, the gate provides a constant power supply thus facilitating the full power mode.

It should be noted that in lighting system in which an anti-cosinus $\phi$ capacitor is installed, an impedance control dimmer assembly similar as in the embodiment in FIG. 3 was found to be advantageous over use of the wave-chopping based system as in the embodiment of FIG. 1. The system of the invention is applicable for a large number of gas discharge lamps. Hitherto available dimmer systems have failed to work with various types of fluorescent lamps which are effectively dimmed by the use of the dimmer assembly of the invention. For example, the assembly of the present invention works very effectively for dimming light of a fluorescent lamp of the kind having a 26 mm diameter, 36 W power employing a so-called rapid start starter. Obviously, the assembly is also applicable for various other lamp types such as, for example, 18 W or 58 W lamps of the same diameter.

In some cases, it is necessary to utilize compensating resistors. Compensating resistors 50 in FIG. 1 and 50' in FIG. 3 are connected in parallel to bypass means 20 and 20', respectively and a compensating resistor 51 is connected between the output terminal 22 line 52. For example, a 5 W, 1 kΩ or 2.5 kΩ compensating resistor is applicable in the case of the abovementioned fluorescent lamp. The determination whether to employ single or both of the compensating resistors and their values is made empirically in each case. It should be noted that the use of such compensating resistor may be utilized also in systems in which gradual dimming controller or bypass means are not required.

The system of the invention is also applicable for dimming light of various compact fluorescent lamps, having integral built-in starters such as those manufactured by OSRAM™ or PHILLIPS™. In this connection it should be noted that for fluorescent lamps utilizing power up to 20 W, a bimetal starter may be utilized, but this has to be replaced with an electronic starter similar to that shown in FIG. 3, where the fluorescent lamps are of a higher power type.

It should be noted that by another embodiment, an additional circuitry may be incorporated to the assembly of the invention, which, in case of an instantaneous power loss delays the resumption of power to the system for a certain time interval, e.g. for 30 secs.

It has further been found that in cases of unstable power supply, in which the input power changes unpredictably, it is advantageous to employ a power control unit which will provide the circuitry of the assembly with stabilized input power regardless of any interference in the actual power supply.

It shall no doubt be appreciated by the artisan that the specifically described embodiments are an example only of a much larger scope of the invention as defined herein. Thus, by way of example, the dimmer assembly of the invention may be used in light system employing sodium or mercury lamps. Furthermore, in the drawings specific values of resistors, capacitors, and diodes are given, it will no doubt be appreciated that various others may be used in the circuits shown in the figures, and also there are various alternative circuitry designs to obtain equivalent function.

I claim:

1. A dimmer assembly for controlling light intensity of a gas discharge lamp, comprising:

dimming controller having an input terminal connectable to one pole of an alternating current source and having an output terminal connectable to the line leading to one of the two filament electrodes of the lamp, the dimming controller being adapted to provide an attenuated and conditioned power at its output terminal;

the dimming controller being adapted upon feeding the input terminal with the current, to operate in a first mode constituting a full power mode for a time period $t_1$, during which the link between the two terminals is in full conductance bringing about full light intensity of the discharge lamp, and being further adapted after $t_1$ to enter into a second mode constituting a dimming mode, during which the link between the two terminals is in partial conductance bringing about attenuated intensity of the discharge lamp; the said time $t_1$ is sufficient to facilitate effective dimming in the dimming mode; said dimmer assembly further comprising:

a starter unit having two terminals one connectable to each of the filament electrodes of the lamp, which, when initially energized enables electrical connectivity between the electrodes, and after a predetermined time delay disconnects the said electrical connectivity, whereby the only connection between the two terminals being then through the discharged gas inside the lamp.

2. A dimmer assembly according to claim 1 in which the dimming controller is further capable of gradually switching, for a transition period $t_2$, between the first full power mode and the second dimming mode.

3. A dimmer assembly according to claim 1 wherein the starter is an electronic starter.

4. A dimmer assembly according to claim 1, further comprising compensator resistor means.

5. A dimming controller according to claim 1, comprising a signal chopping device.

6. A dimming controller according to claim 5, wherein said signal chopping device is a triac.

7. A dimming controller according to claim 1, comprising an impedance control system.

8. A dimmer assembly for controlling light intensity of a gas discharge lamp, comprising:

dimming controller having an input terminal connectable to one pole of an alternating current source and having an output terminal connectable to the line leading to one of the two filament electrodes of the lamp, the dimming controller being adapted to provide an attenuated power at its output terminal;

the dimming controller being adapted upon feeding the input terminal with the current, to gradually switching, for a transition time period $t_2$, into dimming mode in which the link between the two terminals is in partial conductance bringing about attenuated intensity of the discharge lamp, the said transition time $t_2$ is sufficient for facilitating effective dimming; said dimmer assembly further comprising:

a starter unit having two terminals one connectable to each of the filament electrodes of the lamp, which, when initially energized enables electrical connectivity between the electrodes, and after a predetermined time delay disconnects the said electrical connectivity, whereby the only connection between the two terminals being then through the discharged gas inside the lamp.

9. A dimmer assembly according to claim 8 wherein the starter is an electronic starter.

10. A dimmer assembly according to claim 8, further comprising compensator resistor means.

11. A dimmer controller according to claim 8, comprising a signal chopping device.

12. A dimmer controller according to claim 11 in which said signal chopping device is a triac.

13. A dimmer controller according to claim 8, comprising an impedance control system.

14. A lighting system comprising:

one or more gas discharge lamps each having two spaced filament electrodes, each electrode connected to one pole of an electric power source;

choke means and a starter unit associated with each lamp; and a dimmer controller on the electric line connecting one of the filament electrodes of each lamp to the one terminal of the power source;

the dimmer controller and the starter unit being as defined in claim 1.

15. A dimmer controller according to claim 1 further comprising a body guard.

16. A lighting system comprising:

one or more gas discharge lamps each having two spaced filament electrodes, each electrode connected to one pole of an electric power source;

choke means and a starter unit associated with each lamp; and a dimmer controller on the electric line connecting one of the filament electrodes of each lamp to the one terminal of the power source;

the dimmer controller and the starter unit being as defined in claim 8.

17. A dimmer controller according to claim 8 further comprising a body guard.

* * * * *